United States Patent [19]

Krechel

[11] Patent Number: 4,991,908

[45] Date of Patent: Feb. 12, 1991

[54] PORTABLE FOOTREST

[75] Inventor: P. Kurt Krechel, St. Louis, Mo.

[73] Assignee: Smooth Sailing, Inc., High Ridge, Mo.

[21] Appl. No.: 503,219

[22] Filed: Mar. 30, 1990

[51] Int. Cl.[5] ..... A47C 16/00

[52] U.S. Cl. ..... 297/439; 108/132; 108/43

[58] Field of Search ..... 297/438, 439; 108/132, 108/131, 130, 133, 43

[56] References Cited

U.S. PATENT DOCUMENTS

| | | | |
|---|---|---|---|
| 1,298,249 | 3/1919 | Nichol | 100/132 |
| 2,697,018 | 12/1954 | Georgidos | 108/131 X |
| 2,725,269 | 11/1955 | Oakes | 108/133 |
| 3,155,364 | 11/1964 | Berg | 297/439 |
| 3,162,486 | 12/1964 | Emery . | |
| 3,271,075 | 9/1966 | Good . | |
| 3,709,158 | 1/1973 | Kidd | 108/43 |
| 4,010,699 | 3/1977 | Lakso | 100/133 |
| 4,051,788 | 10/1977 | Gindele . | |
| 4,064,815 | 12/1977 | Baum | 108/132 X |
| 4,067,614 | 1/1978 | Confer et al. . | |
| 4,228,745 | 10/1980 | Gace | 297/439 X |
| 4,383,488 | 5/1983 | Macho et al. | 108/130 X |
| 4,462,636 | 7/1984 | Markson | 297/439 |
| 4,536,032 | 8/1985 | Highberger . | |
| 4,549,767 | 10/1985 | Hampshire et al. . | |
| 4,557,200 | 12/1985 | Geschwender | 108/133 X |
| 4,678,234 | 7/1987 | Wilson . | |

FOREIGN PATENT DOCUMENTS

| | | | |
|---|---|---|---|
| 171689 | 6/1906 | Fed. Rep. of Germany | 108/131 |
| 1916985 | 9/1970 | Fed. Rep. of Germany | 297/439 |

*Primary Examiner*—Jose V. Chen

*Attorney, Agent, or Firm*—Senniger, Powers, Leavitt & Roedel

[57] ABSTRACT

A portable footrest comprising a top having a first end, a second end opposite the first end, and an inclined portion located between the first and second ends of the top. A plurality of legs support the top. The legs are pivotally mounted on the top for swinging motion about an axis between a folded position in which the footrest is configured for storage and transportation in a small container such as a briefcase or the like and an upright position in which the footrest is configured for use. The legs may be locked in the upright position. A first pair of the legs is mounted at the first end of the top and a second pair of the legs is mounted at the second end of the top. The first pair of legs is longer than the second pair of legs such that the first end of the top is higher than the second end.

8 Claims, 2 Drawing Sheets

FIG. 1.
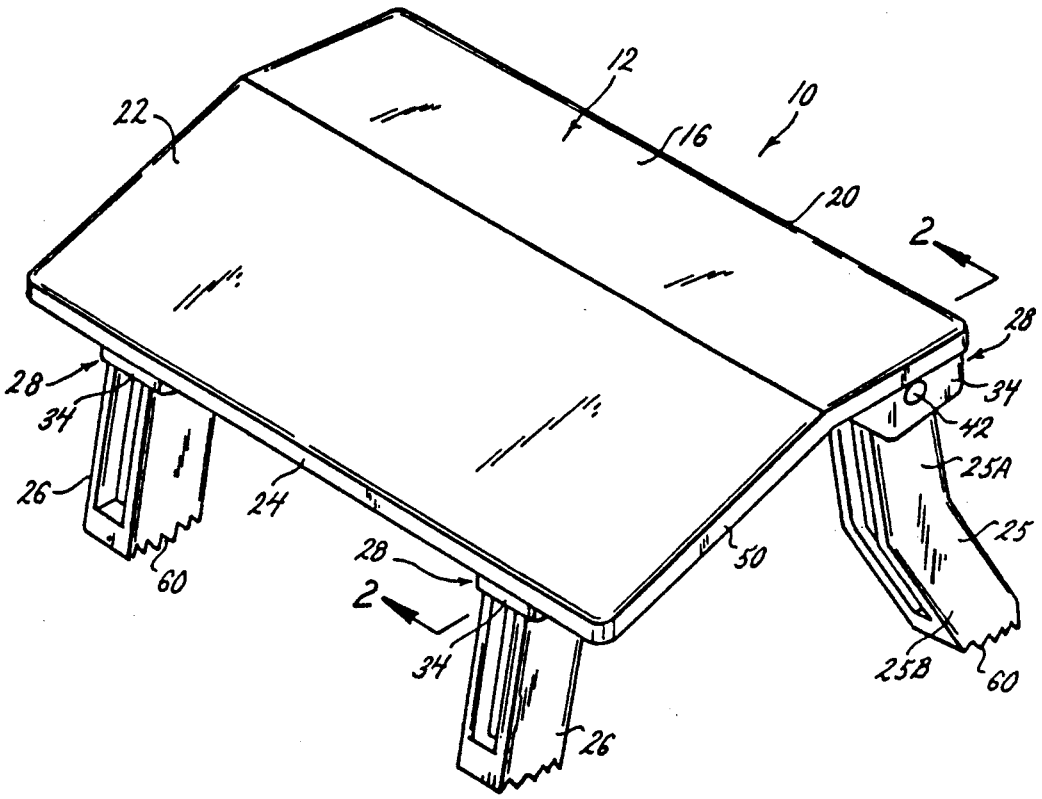
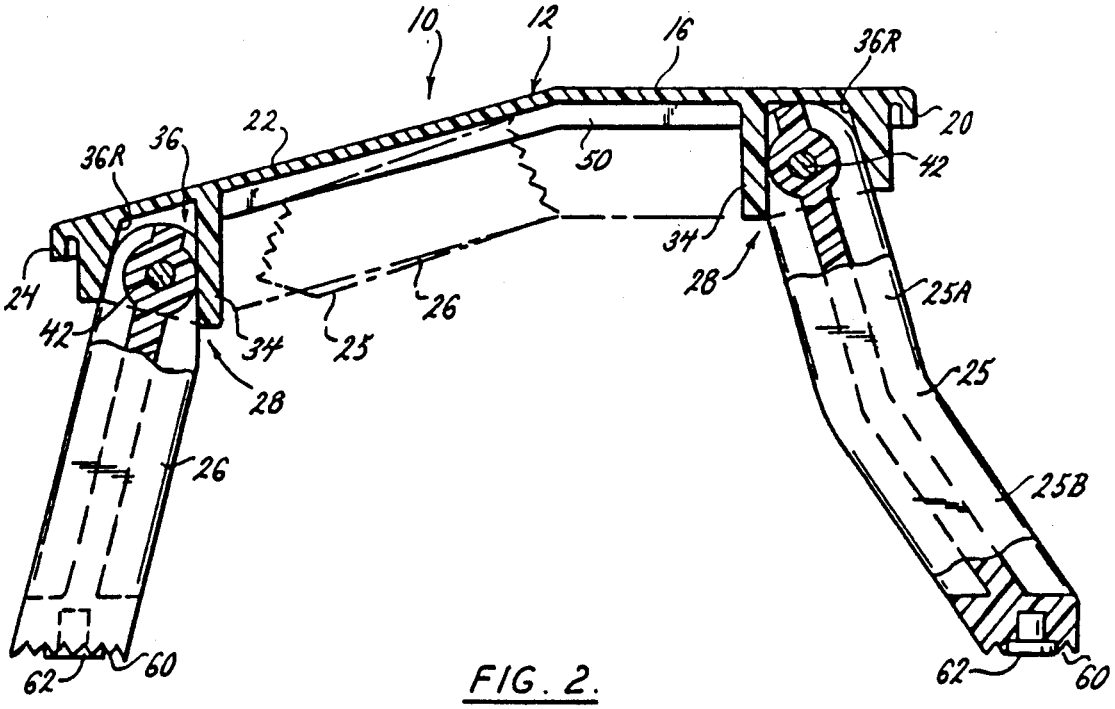
FIG. 2.

PORTABLE FOOTREST

BACKGROUND OF THE INVENTION

This invention relates generally to footrests and more particularly to a portable footrest.

As is known, elevation of the feet while in a sitting position can significantly increase comfort. The comfort is particularly important when someone must remain seated for significant periods of time such as when traveling in an airplane, bus or train. Elevating the feet also raises the knees so that the lap is relatively horizontal, making it much easier to hold papers or other items, such as a lap top computer, used while working on the trip. Heretofore, footrests have been too bulky to conveniently carry or to use in confined areas such as are found on an airplane, bus or train.

SUMMARY OF THE INVENTION

Among the several objects of the present invention may be noted the provision of a portable footrest which is lightweight and may be compactly stored; the provision of such a footrest which can be easily set up for use and broken down for storage and transport; the provision of such a footrest which is of sturdy construction; the provision of such a footrest which holds its position on the floor when in use; and the provision of such a footrest which is inexpensively manufactured.

Generally, a portable footrest constructed according to the principles of the present invention comprises a top having a first end, a second end opposite said first end, and an inclined portion located between said first and second ends. A plurality of legs support the top. The legs are pivotally mounted on the top for swinging motion about an axis between a folded position in which the footrest is configured for storage and transportation in a small container such as a briefcase or the like and an upright position in which the footrest is configured for use. Means is provided for locking the legs in the upright position. A first pair of the legs is mounted at the first end of the top and a second pair of the legs is mounted at a second end of the top. The first pair of legs are longer than said second pair of legs such that the first end of the top is higher than the second end.

Other objects and features will be in part apparent and in part pointed out hereinafter.

BRIEF DESCRIPTION OF THE DRAWINGS

FIG. 1 is a perspective of a footrest of the present invention;

FIG. 2 is a section taken in the plane including line 2—2 of FIG. 1;

Corresponding reference characters indicate corresponding parts throughout the several views of the drawings.

DETAILED DESCRIPTION OF THE PREFERRED EMBODIMENT

Figure 3:
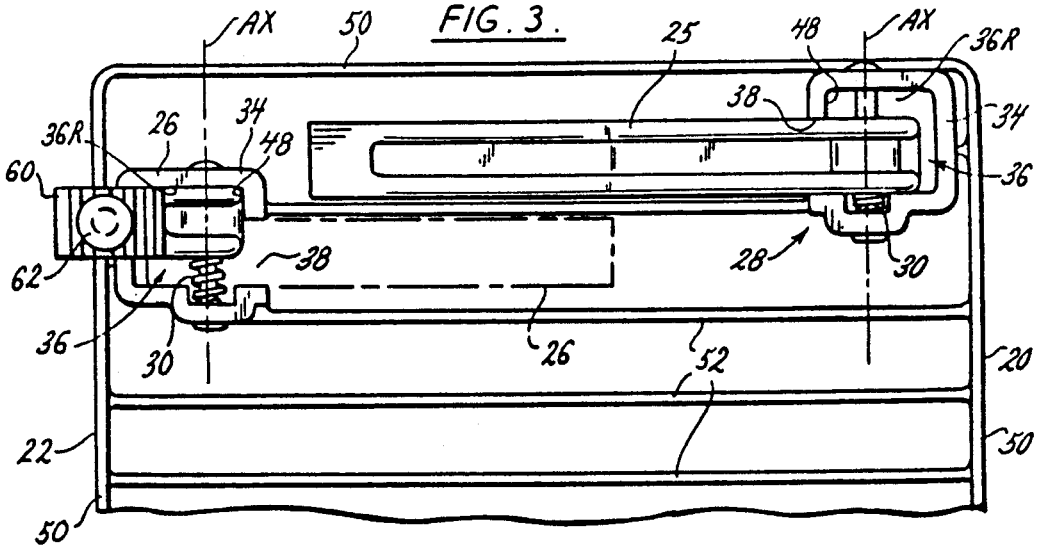
FIG. 3 is a fragmentary view of the underside of the footrest showing one leg in a folded position and another leg in an upright position.
Figure 4:
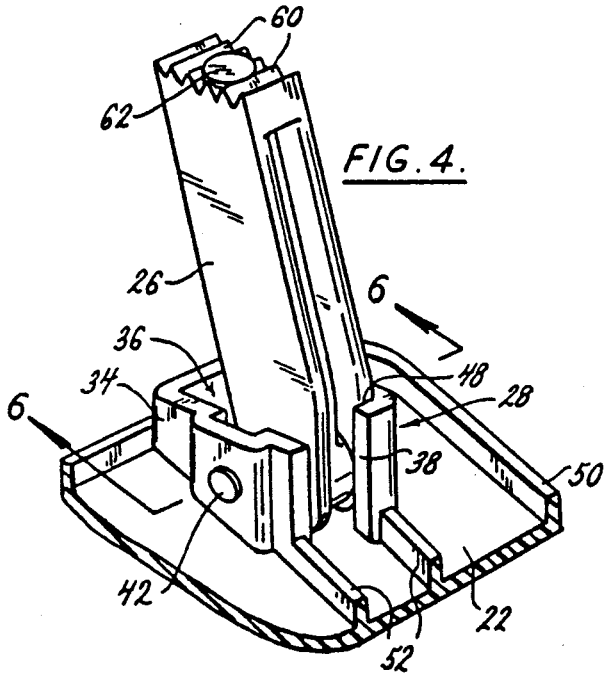
FIG. 4 is a fragmentary perspective of the underside of the footrest showing a leg in its locked upright position.

Referring now to the drawings and particularly to FIG. 1, a portable footrest of the present invention, generally indicated at 10, is shown to comprise a top 12 having a horizontal portion 16 at a first end 20, constituting for purposes of this description the front end of the top, and an inclined portion 22 angled downwardly and extending rearwardly from the horizontal portion 16 to a second (or rear) end 24 of the top. The inclined portion 22 is longer than the horizontal portion 16. The top 12 is supported by two pairs of legs, a first pair 25 being associated with the horizontal portion of the top and a second pair 26 being associated with the inclined portion of the top.

The legs 25, 26 are pivotally mounted on the top for swinging on an axis AX extending laterally of the top between a folded position (shown in phantom in FIG. 2) in which the footrest 10 is configured for storage in a small container such as a briefcase or the like, and an upright position in which the footrest is configured for use. Means, indicated generally at 28, locks the legs in the upright position. As best seen in FIG. 3, one of the legs 25 of the first pair of legs is generally opposite a corresponding leg 26 of the second pair of legs. However, the opposing legs 25, 26 are sufficiently laterally offset so that there is clearance between the legs in the folded position. The folded position of the leg 26 is shown in phantom in FIG. 3. As set forth in greater detail below, the locking means 28 of each of the legs 25, 26 releasably locks the leg in its upright position upon translational movement of the leg generally along the axis AX of its swinging motion. Spring means, constituting in this embodiment a coil compression spring 30, automatically moves the legs 25, 26 along the axes AX to their locked positions when the legs reach their upright positions.

The means 28 for locking the legs in the upright position includes mounting blocks 34, each integrally formed with and depending downwardly from the top 12. The mounting blocks 34 each have a generally downwardly opening socket, indicated in its entirety by the reference numeral 36, and an opening 38 therein facing the end of the top opposite the mounting block. Each opening 38 is adapted to receive a portion of a leg therein when the leg is laterally aligned with the opening. The mounting block socket 36 extends generally parallel to the plane of the opening 38 and has a width greater that the width of the opening. The mounting blocks 34 for each of the legs 25, 26 are substantially identical. Thus, for purposes of further describing the mounting blocks, reference will be made to a single mounting block 34 and a single leg 25, or 26 mounted therein. However, the description is applicable to all of the mounting blocks and legs.

Figure 5:
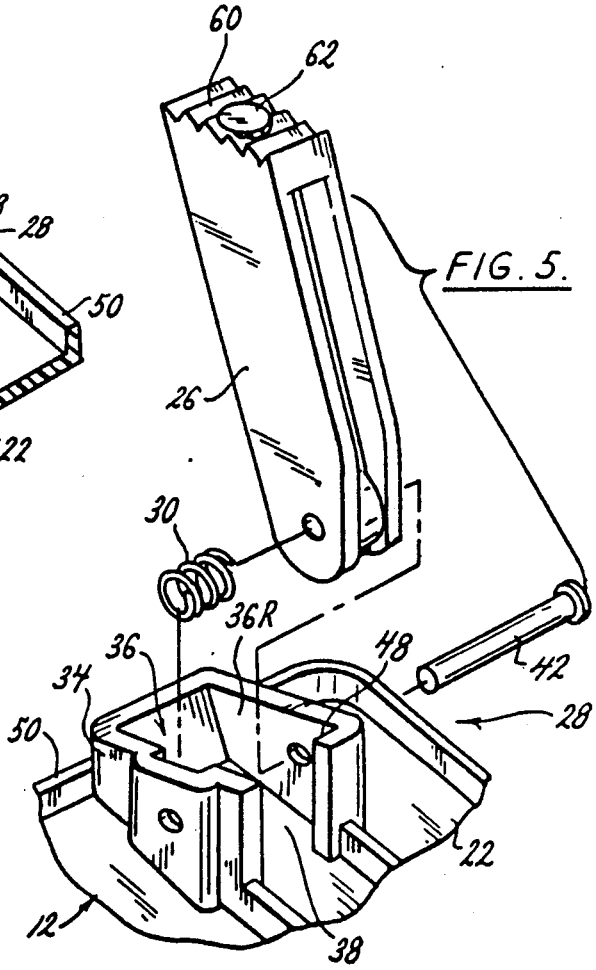
FIG. 5 is an exploded perspective of a leg of the footrest showing its assembly with the top.
Figure 6:
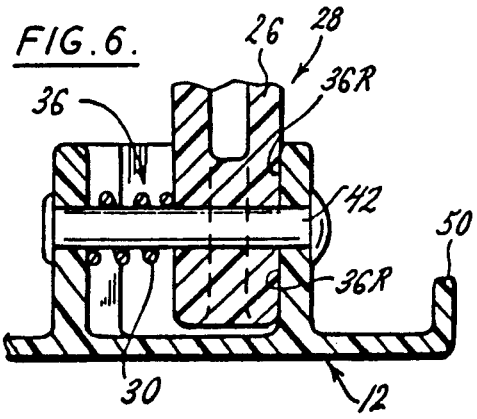
FIG. 6 is a section taken in the plane including line 6—6 of FIG. 4.

A pin 42 mounts the leg 26 on the mounting block 34 in the socket 36. An exploded perspective of the assembly of the leg 26 in the mounting block 34, is shown in FIG. 5. In addition to pivoting on the pin 42 (which defines the axis AX of the leg's swinging motion) between the folded and upright positions, the leg 26 may move translationally along its pin. The socket 36 of the mounting block 34 includes a recessed portion 36R which is laterally recessed from the opening 38 and, enclosed on three sides by walls of the mounting block 34. The recessed portion 36R is adapted to receive the leg 26 in its upright position for locking the leg in its upright position. The coil spring 30 is disposed on the pin 42 and compressed between a wall of the mounting block opposite the recessed portion 36R and the leg 26. The force of the compressed spring 30 biases the leg toward the recessed portion 36R.

The front to rear dimension of the socket 36 is only slightly greater than the width of the portion of the leg 26 received in the socket. Therefore, when the leg 26 is in its folded position, or indeed substantially any angular position except for the upright position, a portion of the leg is received in the laterally outwardly facing opening 38. In the opening 38, the leg engages the mounting block 34 and is held from translational movement along the pin 42, but may pivot about the pin on the axis AX. When the leg 26 moves out of the opening 38 to the upright position, the force of the spring 30 against the leg causes it to move rapidly along the pin 42 into the recessed portion, 36R. In the recessed portion, as shown in FIG. 3, a sidewall 48 of the mounting block 34 is disposed between the leg 26 and the direction of its swinging motion to the folded position. Thus, the leg 26 is locked in the upright position until such time as the leg is moved laterally along the pin 42 against the force of the spring 30 and into registration with the opening 38.

The top 12 is generally rectangular in shape and is made of lightweight molded plastic with an integral, continuous lip 50 depending from its peripheral edges. The legs 25, 26 are likewise made of lightweight molded plastic. The dimensions of the top 12 shown in the drawings are approximately 8 inches in length (measured from front end 20 to rear end 24 of the top), 13 inches in width, and 2 inches in depth. Therefore, when the legs 25, 26 are placed in their folded positions, the entire footrest 10 may be easily stored and transported in a small container such as a briefcase. It is to be understood that although the footrest 10 should be relatively small in size, the top 12 could have other than the precise dimensions described herein and still fall within the scope of the invention. As shown in FIG. 3, the top 12 includes a plurality of ribs 52 integrally formed on the underside of the top to strengthen the top. The ribs 52 extend between the first (front) end 20 of the top 12 and the second (rear) end 24 of the top. The ribs 52 support the top 12 against bending about an axis extending side-to-side of the top under the weight of feet resting on the top. The portions of the lip 50 extending parallel to the ribs 52 also reinforce against bending about the side-to-side axis. The portions of the lip 50 extending side-to-side of the top 12 support it against bending about an axis extending generally front-to-rear of the footrest.

The inclined portion 22 of the top slopes down at an angle of approximately 20° with respect to the horizontal portion 16. A person in a seated position, particularly one of average height or somewhat less, may rest his feet flat against the inclined portion 22 at a natural position with the knees flexed and elevated so that the lap is substantially horizontal. Therefore, in addition to providing a comfortable, elevated position for the feet and legs, the lap is levelly positioned by the footrest 10 so that items used while working (e.g., papers or a lap top computer) may rest in the lap without slipping off. Thus, the footrest of the present invention allows someone seated on an airplane, bus, train or the like to work comfortably.

The upper end of each leg 25, 26, which is received in one of the sockets, is beveled such that each leg projects downwardly from its mounting block 34 at an angle to the vertical. The angled projection of the legs provides for greater stability of the footrest when in use. As may be seen in FIG. 2, the legs 25 mounted on the horizontal portion 16 of the top 12 each have an upper portion 25A and a lower portion 25B angled outwardly with respect to the upper portion and the top. When the inclined portion 22 is loaded, the weight supported by the footrest 10 will have a substantial component parallel to the floor in a (forward) direction away from the seated person. This component of force tends to cause the footrest 10 to tip and also to slide across the floor. The angled shape of the legs 25 associated with the horizontal portion 16 allows the lower portion of the legs 25B to engage the floor forward of the first (front) end 20 of the top and the upper portions 25A of the legs. The lower portions 25B of the legs therefore brace the footrest 10 against tipping over. The intersection of the upper portion 25A and the lower portion 25B corresponds to the line of intersection between the horizontal portion 16 and inclined portion 22 of the top. The angled construction of the first legs 25 thus allows them to fit flat against the underside of the top 12 in the folded position for compact storage.

As stated above, a significant component of the load supported by the inclined portion 22 of the top 12 is directed forwardly of the footrest and tends to cause the footrest 10 to slide across the floor. However, the lower ends of each of the legs 25, 26 have an a plurality of integrally formed teeth 60 for gripping carpet or the like on the floor to hold the footrest 10 from sliding. Further, a generally cylindric stop 62 made of rubber or a similar, high friction material is received in a bore in the lower end of each leg 25, 26. The teeth 60 and the stops 62 constitute holding means in this embodiment. The stops 62 project downward from the lower ends of the legs 25, 26 and engage the floor. The enhanced gripping action of the rubber stops 62 aids in holding the footrest 10 against sliding, particularly on harder floors where the teeth 60 cannot dig in to grip the floor.

Thus it may be seen that the footrest 10 described satisfies the several objects of the present invention. The footrest is lightweight and may be broken down for compact storage and transportation, and then easily set up when needed. Despite the fact that the footrest is lightweight and may be easily broken down, the reinforcing ribs of the top give the footrest a sturdy construction. The legs 25, 26 releasably lock in their upright positions to provide stability when the footrest is in use. The teeth 60 and rubber stops 62 on the lower ends of the legs hold the footrest from sliding across the floor when supporting a load on its inclined surface. The footrest is also simple in design allowing it to be inexpensively manufactured.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A portable footrest comprising a top having a first end, a second end opposite said first end, and an inclined portion located between said first and second ends, a plurality of legs supporting the top, the legs being pivotally mounted on the top for swinging motion about an axis between a folded position in which the footrest is configured for storage and transportation in a small container such as a briefcase or the like and an upright position in which the footrest is configured for use, and means for locking the legs in the upright position, a first pair of legs each having an upper portion and a lower portion, said lower portion being angled outwardly with respect to said upper portion and the top, said first pair of legs being mounted on the top at said first end thereof, and a second pair of legs mounted on the top at said second end thereof, each leg of said first pair of legs being generally opposite a corresponding leg of said second pair of legs, the opposite legs being sufficiently laterally offset to provide clearance for the opposite legs in the folded position, said first pair of legs being longer than said second pair of legs such that said first end of the top is higher than said second end.

2. A portable footrest as set forth in claim 1 further comprising means associated with each leg for holding the footrest from sliding across the floor, said holding means comprising a plurality of teeth formed on the lower end of each leg for gripping carpet or the like on the floor, and a stop of rubber or a like material projecting downwardly from the lower end of the leg.

3. A portable footrest comprising a top having a first end, a second end opposite said first end, and an inclined portion located between said first and second ends, a plurality of legs supporting the top, the legs being pivotally mounted on the top for swinging motion about an axis extending laterally of the top between a folded position in which the footrest is configured for storage and transportation in a small container such as a briefcase or the like and an upright position in which the footrest is configured for use, and means for locking the legs in the upright position, a first pair of legs being mounted on the top at said first end thereof and a second pair of legs being mounted on the top at said second end thereof, each leg of said first pair of legs being generally opposite a corresponding leg of said second pair of legs, the opposite legs being sufficiently laterally offset to provide clearance for the opposite legs in the folded position, said first pair of legs being longer than said second pair of legs such that said first end of the top is higher than said second end, said means for locking the legs in the upright position comprising a mounting block for each leg, each mounting block depending downwardly from the top and having a generally downwardly opening socket, a pin mounting the leg in the socket and spring means for moving the leg translationally along the pin in the upright position, the mounting block having an opening therein facing the end of the top opposite the mounting block, said opening being adapted to receive a portion of the leg therein when the leg is laterally aligned with said opening, said socket including a portion laterally recessed from said opening which is adapted to receive a portion of the leg upon translational movement of the leg in the socket for locking the leg in its upright position, said recessed portion being defined in part by a wall of the mounting block facing the end of the top opposite the mounting block, said wall being disposed in the path of said swinging motion of the leg when the leg is received in the recessed portion.

4. A portable footrest as set forth in claim 3 wherein said spring means comprises a coil compression spring, the spring being disposed on the pin and engaging the leg in the socket to bias the leg toward the recessed portion of the socket.

5. A portable footrest comprising a top and a plurality of legs supporting the top, the top having a horizontal portion at a first end thereof and an inclined portion angled downwardly from the horizontal portion toward a second end thereof, the inclined portion being longer than the horizontal portion, the legs being pivotally mounted on the top for swinging motion about an axis extending laterally of the top between a folded position in which the footrest is configured for storage and transportation in a small container such as a briefcase or the like and an upright position in which the footrest is configured for use, and means for locking the legs in the upright position, a first pair of legs being mounted on the top at said first end thereof and a second pair of legs being mounted on the top at said second end thereof, the legs of said first pair of legs each having an upper portion and a lower portion, said lower portion being angled outwardly with respect to said upper portion and the top, said first pair of legs being longer than said second pair of legs such that said first end of the top is higher than said second end, each leg of said first pair of legs being generally opposite a corresponding leg of said second pair of legs, the opposite legs being sufficiently offset to provide clearance for the opposite legs in the folded position.

6. A portable footrest as set forth in claim 5 further comprising means associated with each leg for holding the footrest from sliding across the floor, said holding means comprising a plurality of teeth formed on the lower end of each leg for gripping carpet or the like on the floor, and a stop of rubber or a like material projecting downwardly from the lower end of the leg.

7. A portable footrest comprising a top and a plurality of legs supporting the top, the top having a horizontal portion at a first end thereof and an inclined portion angled downwardly from the horizontal portion toward a second end thereof, the inclined portion being longer than the horizontal portion, the legs being pivotally mounted on the top for swinging motion about an axis extending laterally of the top between a folded position in which the footrest is configured for storage and transportation in a small container such as a briefcase or the like and an upright position in which the footrest is configured for use, and means for locking the legs in the upright position, a first pair of legs being mounted on the top at said first end thereof and a second pair of legs being mounted on the top at said second end thereof, each leg of said first pair of legs being generally opposite a corresponding leg of said second pair of legs, the opposite legs being sufficiently laterally offset to provide clearance for the opposite legs in the folded position, said means for locking the legs in the upright position comprising a mounting block for each leg, each mounting block depending downward from the top and having a generally downwardly opening socket, a pin mounting the leg in the socket and spring means for moving the leg translationally along the pin in the upright position, said mounting block having an opening therein facing the end of the top opposite the mounting block, said opening being adapted to receive a portion of the leg therein when the leg is laterally aligned with said opening, said socket including a portion laterally recessed from said opening which is adapted to receive a portion of the leg upon translational movement of the leg in the socket for locking the leg in its upright position, said recessed portion being defined in part by a wall of the mounting block facing the end of the top opposite the mounting block, said wall being disposed in the path of said swinging motion of the leg when the leg is received in the recessed portion.

8. A portable footrest as set forth in claim 7 wherein said spring means comprises a coil compression spring, the spring being disposed on the pin and engaging the leg in the socket to bias the leg toward the recessed portion of the socket.

* * * * *